United States Patent [19]

Chiu

[11] 4,445,917

[45] May 1, 1984

[54] PROCESS FOR LIQUEFIED NATURAL GAS

[75] Inventor: Chen-Hwa Chiu, Houston, Tex.

[73] Assignee: Air Products and Chemicals, Inc., Allentown, Pa.

[21] Appl. No.: 376,079

[22] Filed: May 10, 1982

[51] Int. Cl.[3] ..... F25J 1/02

[52] U.S. Cl. ..... 62/25; 62/28; 62/29; 62/31; 62/34; 62/43

[58] Field of Search ..... 62/24, 27, 28, 29, 9, 62/11, 31, 32, 34, 40, 42, 43, 44, 25

[56] References Cited

U.S. PATENT DOCUMENTS 3,747,359 7/1973 Streich ..... 62/40

4,331,461 5/1982 Kabosky et al. ..... 62/28

*Primary Examiner*—Frank Sever

*Attorney, Agent, or Firm*—Geoffrey L. Chase; E. Eugene Innis; James C. Simmons

[57] ABSTRACT

A process is disclosed for producing a purified liquefied natural gas (LNG) from a raw natural gas feed containing methane and hydrocarbon impurities of $C_2$ and higher wherein the raw feed is cooled, distilled to remove impurities, and liquefied, such that the distillation reflux is supplied by a portion of a subcooled methane-rich liquid stream exiting the middle bundle of a three bundle main cryogenic heat exchanger having a mixed cryogenic refrigerant. The raw feed is cooled in the first bundle of said main exchanger.

7 Claims, 2 Drawing Figures

PROCESS FOR LIQUEFIED NATURAL GAS

TECHNICAL FIELD

This invention relates to a process for the purification and liquefaction of a natural gas feed stream to form a purified liquefied natural gas.

BACKGROUND OF THE PRIOR ART

Natural gas as it exists in the form when taken from a mine, an oil field, or a gas field typically contains heavy hydrocarbon components and other impurities in addition to the predominant component of methane. The heavy hydrocarbon impurities, i.e., for present purposes any hydrocarbon having an organic structural formula of two or more carbon atoms and typically having carbon atoms in the range of $C_2$–$C_{10}$, are notably present when the natural gas is taken from an oil field. Before the natural gas can be used efficiently as a feedstock either as a fuel or as a chemical feed, it is purified by removing the higher order hydrocarbon components than methane and other impurities. The purification process may embody a cryogenic distillation of the natural gas using known refrigeration techniques such that a liquefied and purified natural gas feedstock is provided.

SUMMARY OF THE INVENTION

A process has been discovered to provide a purified and liquefied natural gas (LNG) from a raw natural gas feed, while eliminating the need for the raw natural gas feed precooler and the reflux separator as used in the conventional scheme and, at the same time, providing a reduced energy requirement in terms of reduced refrigeration demand and a reduced equipment requirement, not only in eliminating the apparatus of the conventional precooler and reflux separator but also in reducing the required surface area in the cryogenic main heat exchanger. The process of the present invention precools a raw natural gas feed containing methane and hydrocarbon impurities of $C_2$ and higher, distills the cooled feed in a cryogenic distillation column to form a scrubbed overhead vapor rich in methane and a bottoms liquid of impurities, cools the scrubbed overhead vapor to a temperature sufficient to condense and subcool the methane component, uses as a reflux to the distillation column a portion of the subcooled methane rich liquid, and cools the remainder of the methane-rich liquid to form a liquefied and purified natural gas.

A preferred embodiment of the improved process cools and separates a raw natural gas feed to provide a liquid feed and a vapor feed to a distillation column, distills the vapor feed and liquid feed in the distillation column to form a scrubbed overhead vapor rich in methane and a bottoms liquid rich in impurities, cools the scrubbed overhead vapor to a temperature sufficient to liquefy and subcool the methane component, and uses as a reflux to said distillation column a portion of the subcooled scrubbed overhead vapor at a temperature below the boiling point of methane.

A further embodiment of the improved process includes precooling the vapor feed in heat exchange against the bottoms liquid in the lower end of the distillation column, at the same time providing reboiler heat to the column.

The improved process can take full advantage of a three bundle main cryogenic heat exchanger having a mixed cryogenic refrigerant (MCR). In this manner, the improved scheme precools the raw natural gas feed to the distillation column in the first or "warm" bundle of a three bundle cryogenic main heat exchanger, and the overhead vapor of the distillation column is condensed and subcooled in the second or "middle" bundle of the cryogenic main heat exchanger. A portion of the subcooled liquid from the middle bundle provides the reflux to the distillation column with the remainder going through the third or "cold" bundle of the main exchanger to be cooled to provide liquefied and purified natural gas product.

The improved process uses a colder reflux provided by a portion of a totally condensed and subcooled liquid in a stream exiting the middle bundle of the main exchanger. The reflux is substantially lower in temperature and higher in flow than the reflux of the conventional process scheme. However, the improved process unexpectedly provides a higher efficiency in terms of a reduced refrigeration requirement and, at the same time, a reduced size and lower cost cryogenic main heat exchanger in addition to the eliminations of the feed precooler and the reflux separator employed in the conventional process.

DETAILED DESCRIPTION OF THE INVENTION

Figure 1:
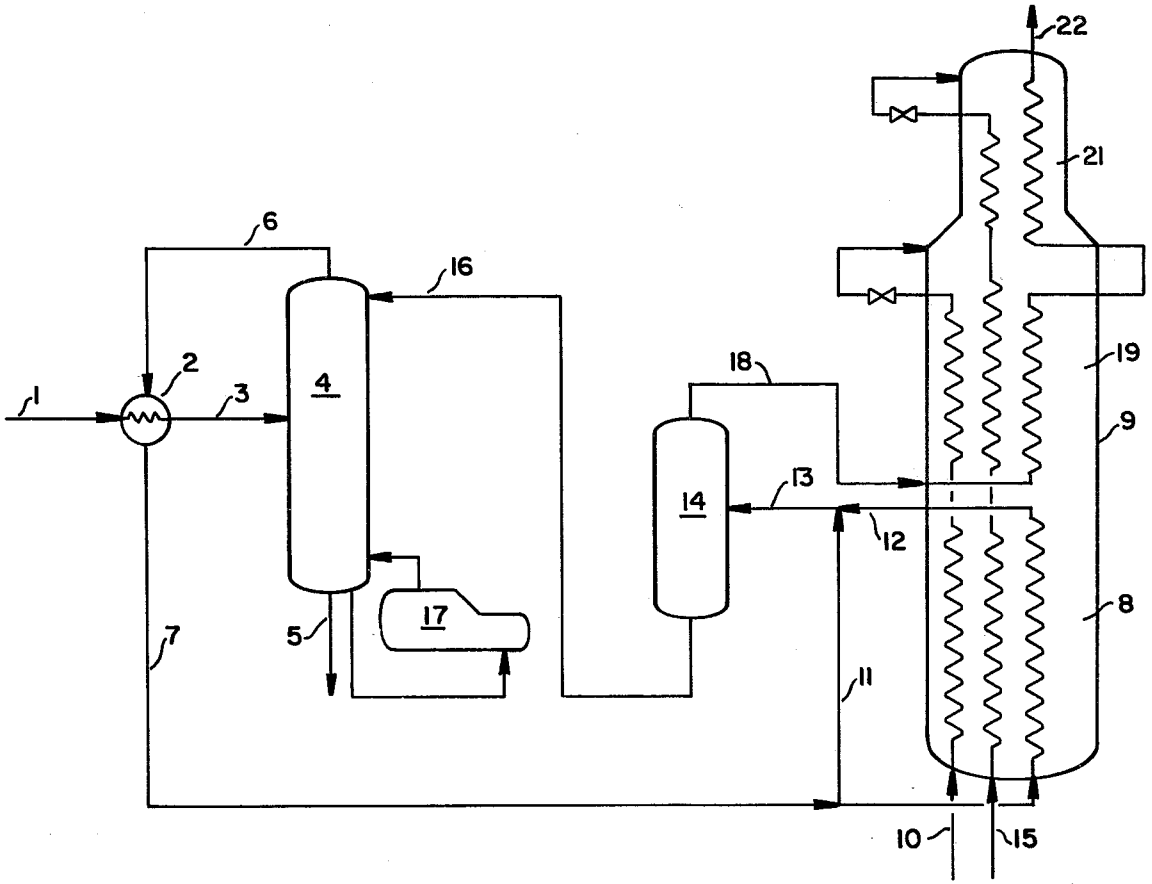
FIG. 1 Prior Art
FIG. 1 is a schematic diagram of a prior art process system for the purification and liquefaction of natural gas.

One conventional process scheme such as used by Air Products and Chemicals, Inc., (APCI) for liquefying and purifying raw natural gas uses a cryogenic main heat exchanger having three bundles or zones to provide heat exchange means for cooling. Referring to FIG. 1, identified as prior art, a raw natural gas taken from an oil field is passed in line 1 through precooler 2 prior to introduction through line 3 to cryogenic distillation column 4. The natural gas is distilled within column 4 in a manner to separate methane from higher hydrocarbon components and other impurities which are removed from the column as bottoms liquid in stream 5. Overhead vapor containing a higher methane fraction is removed from the column and is passed in line 6 to precooler 2. The overhead vapor from the column 4 is used in precooler 2 to provide the cooling for the raw natural gas feed to the process. The overhead vapors warmed in precooler 2 are passed via line 7 to the first or "warm" bundle, indicated generally as 8, in a cryogenic main heat exchanger 9. Refrigeration in main exchanger 9 is provided by a mixed cryogenic refrigerant (MCR) in lines 10 and 15. A portion of the overhead vapor in line 7 by-passes heat exchanger 9 and joins the cooled portion of the overhead in line 12 to form a two phase stream in line 13. The two phase nature of stream 13 indicates the absence of significant subcooling. The purpose of the bypass is to control against overcooling or subcooling and to supply only the required reflux for column 4 through stream 16. The two phase stream in line 13 is introduced to a separator 14 wherein liquid and vapor are separated. Liquid from the separator is passed in line 16 to the top of column 4 and serves as reflux to the distillation column. Since all of the liquid in line 13 is used for refluxing, bypass 11 around the warm bundle circuit is used to control the reflux so that excess refrigeration will not be consumed from the mixed refrigerant and transferred to the distillation column 4. Excess surface area is provided in the warm bundle to accommodate a set amount of by-pass flow, for example, 15%. This requires design of the warm bundle 8 with a substantial excess of surface area since the mean temperature differences (driving force for heat transfer) is reduced. The reflux provides the conventional method for ensuring an adequate separation of the raw natural gas into a methane rich overhead in line 6 and higher hydrocarbon components and other impurities which are removed from column 4 as bottoms liquid in line 5. Reboiler heat for the distillation column is provided by reboiler 17. Vapor from separator 14 is passed in line 18 through the middle bundle, indicated generally as 19, and further through the cold bundle or third bundle, indicated generally as 21, of main exchanger 9. A purified and liquefied natural gas is removed from cryogenic main heat exchanger 9 as product in line 22.

The conventional process design as described in the preceding paragraph uses the cold potential of the distillation column overhead to precool the feed to the distillation column. The distillation column overhead is thereby heated against the feed and then is cooled down through the warm bundle of the main exchanger. The conventional scheme is designed to recover refrigeration from the overhead vapors from the distillation column and to transfer that recovered refrigeration to the raw natural gas feed through the precooler.

However, in the conventional process scheme described above, the precooler indicated as 2 in FIG. 1 is a piece of cryogenic heat exchanger apparatus which requires a very large surface area made of special alloy steel or other expensive materials and is very costly.

In a process such as the purification of natural gas, it is always desirable to improve, i.e., reduce, the energy and equipment requirements of the process. At the same time, it is commonly true that a decrease in an energy requirement requires an increase in the required equipment, and, conversely, a decrease in the required equipment usually means an increase in energy requirement.

Figure 2:
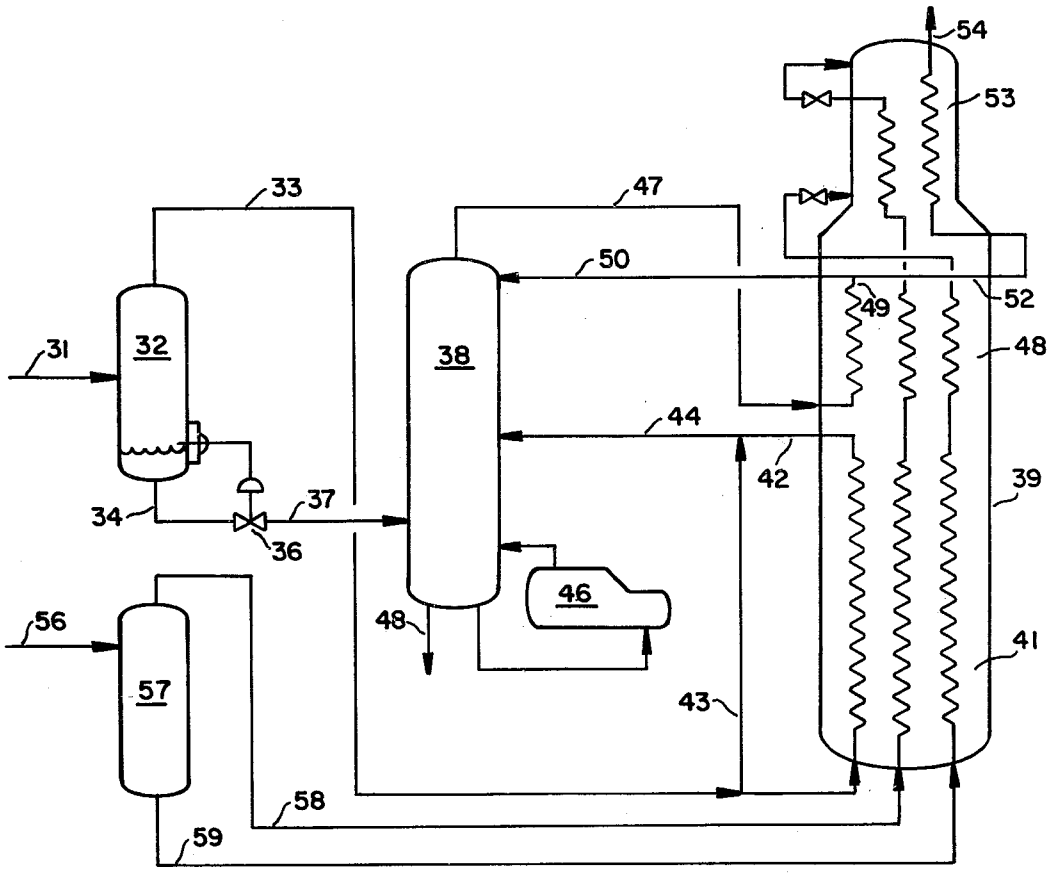
FIG. 2 is a schematic diagram of an improved process system for the purification and liquefaction of natural gas in accordance with the novel method of the instant invention.

Referring to FIG. 2, a raw natural gas feed from a coal mine, a gas field, or an oil field or other source containing methane and higher hydrocarbons and other impurities is cooled by conventional means (not shown) and passed via line 31 to separator 32. The feed is separated into an overhead vapor 33 and a bottoms liquid 34. The bottoms liquid 34 is expanded to a lower pressure in level control valve 36 and then in passed in line 37 to distillation column 38. The overhead vapor from the separator in line 33 is passed to a cryogenic main heat exchanger indicated generally as 39 and is introduced to the first or "warm" bundle, which is indicated generally as 41, and exits as cooled stream 42. A portion of the vapor in line 33 is by-passed around the main heat exchanger in line 43 and is joined with line 42 to form a cooled distillation column feed in line 44 which is introduced to distillation column 38 at a position higher in the column than the liquid feed in line 37, e.g., if the liquid in line 37 is introduced at the sixth tray from the top, the feed in line 44 will be introduced at the fourth tray. Distillation column 38 has reboiler 46, the heat duty of which may be provided by line 33, although not shown in FIG. 2, thereby improving on the efficiency by reducing the refrigeration load of the warm bundle. Methane is removed from distillation column 38 as overhead in line 47, and higher hydrocarbon components, e.g., $C_2$–$C_{10}$ paraffins and aromatics including benzene and toluene and other impurities are removed as bottoms liquid in line 48. The overhead from the distillation column is passed in line 47 to the middle bundle of the main heat exchanger, which middle bunch is indicated generally as 48, where the vapors are condensed and subcooled and exit the middle bunch as subcooled liquid in line 49. A portion of the subcooled liquid in line 49 is used as reflux by introduction to distillation column 38 near the top of the column via line 50. Depending on variable operating conditions such as feed compositions and process temperatures, the reflux stream can be subcooled by over 100° F. and preferably is subcooled in the range of 10° F. to 100° F. below the bubble point of the reflux stream and more preferably in the range of 50° F. to 100° F. below the reflux stream bubble point. The remainder of the subcooled liquid is passed in line 52 through the third or cold bundle of the main heat exchanger, which cold bundle is indicated generally as 53, and exits in line 54 as purified liquefied natural gas.

Refrigeration for the improved process is provided by a mixed cryogenic refrigerant (MCR), selected for the suitability of its cooling curve with respect to the condensation requirements of the raw natural gas feed to the process in stream 31. Compressed mixed cryogenic refrigerant (MCR) is passed in line 56 to separator 57. MCR vapor in line 58 and MCR liquid in line 59 are passed to the cryogenic main heat exchanger 9 and are passed and sprayed through the main exchanger in a manner designed for maximum efficiency with respect to the cooling curves required.

For the purpose of providing a complete description of the improved process and the advantages over conventional schemes, the following example is reported.

ILLUSTRATIVE EMBODIMENT

A raw natural gas containing methane and higher hydrocarbons and other impurities from a Middle Eastern oil field and having the constituents listed in Table 1 is fed at the same flow rate and temperature to each of (1) the conventional process as represented in FIG. 1 and (2) the improved process as represented in FIG. 2.

TABLE 1

| Component | Mol % |
|---|---|
| Nitrogen | 0.059 |
| Methane | 92.421 |
| Ethane | 4.787 |
| Propane | 1.940 |
| Isobutane | 0.239 |
| Butane | 0.449 |
| Isopentene | 0.049 |
| Pentene | 0.051 |
| Hexane | 0.006 |

The raw natural gas feed is processed in the conventional manner described in FIG. 1 and separately in a manner in accordance with improved process described in FIG. 2 such that the purified and liquefied natural gas LNG product suitable for use as a feedstock when extracted from the cryogenic main heat exchanger in line 22 of the conventional process and line 54 of the improved process are at the same temperature and pressure. Similarly, the bottoms or liquid impurities from the conventional process in line 5 of FIG. 1 and the bottoms or liquid impurities from the improved process in line 48 of FIG. 2 are extracted at the same pressure and temperature.

Although not part of the prior art, a separator such as indicated by separator 32 in FIG. 2 is used in the conventional scheme for comparison purposes. Referring now to the conventional process as represented in FIG. 1, a raw natural gas feed at a pressure of 686 psia and a temperature of −25° F. is fed to a separator (not shown). The overhead vapor feed from the separator at 686 psia and −25° F. is passed through precooler 2 as indicated in FIG. 1 and is introduced to distillation column 4 through line 3. The bottoms liquid from the separator 14 at a pressure of 686 psia and a temperature of −25° F. is passed to distillation column 4. Overhead vapor from the distillation column at a pressure of 670 psia and a temperature of −96° F. is passed in line 6 to precooler 2 and is warmed in heat exchange with the vapor feed from the separator in line 1 which vapor feed is cooled to about −85° F. prior to being introduced to the distillation column 4. The warmed distillation column overhead vapor is passed in line 7 to the first bundle, or warm bundle, of cryogenic main heat exchanger 9 and is introduced thereto at a pressure of 660 psia and a temperature of −32° F. The cooled distillation overhead vapor in line 13 at a pressure of 640 psia and at a temperature of −107° F. is introduced to separator 14. Bottoms liquid from separator 14 provides reflux to distillation column 4 through line 16. The overhead vapor from the separator is passed through the middle bundle 19 and subsequently the third or cold bundle 21 of the cryogenic main heat exchanger and exits as liquefied purified natural gas in line 22 at a pressure of 200 psia and a temperature of −215° F.

Now referring to the improved process and FIG. 2, a raw natural gas feed in line 31 having the composition as identified above in Table 1 at a pressure of 686 psia and a temperature of −25° F. is fed to separator 32. The bottoms liquid feed from the separator 32 is passed through line 34, level control valve 36, and line 37 and is introduced to distillation column 38 at a pressure of 672 psia and a temperature of −26° F. The vapor feed from the separator is passed in line 33 to the main exchanger to be cooled against a mixed cryogenic refrigerant in the first or warm bundle of main exchanger 39. The cooled feed in line 44 is passed to the distillation column 38 and is introduced at the fourth tray of a nine tray distillation column at a pressure of 666 psia and a temperature of −80° F. Overhead vapor from the distillation column at a pressure of 670 psia and a temperature of −105° F. is passed in line 47 to the middle bundle 48 of main cryogenic heat exchanger 39 and therein is condensed and subcooled to a temperature of −190° F. A portion of the subcooled liquid, i.e., in this particular case 23.4% by weight, is directed through line 50 to be used as reflux to the distillation column and is introduced to the top of the distillation column 38 at a temperature of −189° F. The reflux stream has a bubble point of −115° F. and a dew point of −107° F. In this way, it can be seen that the reflux stream is subcooled by over 70° F. The remainder of the subcooled liquid is passed in line 52 through the third or cold bundle 53 of heat exchanger 39 and exits as liquefied purified natural gas at a temperature of −215° F. and a pressure of 200 psia. The mixed cryogenic refrigerant supplying the refrigeration and entering the system at 56 has a composition identified in Table 2.

A comparison of results obtained from the conventional scheme versus the improved process scheme is shown in Table 2. The improved scheme has only about 98% of the total mixed cryogenic refrigerant (MCR) flow and 98% of the MCR compressor power requirements as compared to that of the conventional scheme. However, not only has the improved scheme eliminated the feed precooler and reflux separator of the conventional scheme but also the total surface area of the main exchanger in the improved scheme is only 85% of that of the conventional scheme.

The cooling duties of feed or LNG streams in the main exchanger are also compared. The total duty of the improved scheme is about 94% of that of the conventional.

TABLE 2

| | Conventional (A) | Improved Process (B) | B/A |
|---|---|---|---|
| MCR | | | |
| Mole % $N_2$ | 1.15 | 1.15 | |
| $C_1$ | 40.33 | 39 33 | |
| $C_2$ | 54.95 | 57.95 | |
| $C_3$ | 3.57 | 1.58 | |
| Total Flow Bundle (lb. mol/hr.) | 40,574 | 39,855 | 98% |
| MCR Compressors (BHP) | | | |
| MCR-1 | 31,787 | 31,282 | |
| MCR-2 | 31,350 | 30,850 | |
| Total | 63,137 | 62,132 | 98% |
| Heat Transfer Area ($ft^2$) | | | |
| Warm Bundle | 100% | 58% | |
| Middle Bundle | 100% | 128% | |
| Cold Bundle | 100% | 138% | |
| Total | 100% | 85% | 85% |
| Feed or LNG Duties (MMBTU/HR) | | | |
| Warm Bundle | 55.51 | 32.59 | |
| Middle Bundle | 87.20 | 104.66 | |
| Cold Bundle | 16.52 | 11.41 | |
| Total | 158.82 | 148.66 | 94% |

What is claimed is:

1. A process for purifying and liquefying a raw natural gas feed containing methane and hydrocarbon impurities of $C_2$ and higher against a refrigerant in a cryogenic main heat exchanger comprising:

(a) cooling said raw natural gas feed to form a cold feed;

(b) separating said feed to form a first feed vapor and a second feed liquid;

(c) cooling said first feed vapor against said refrigerant in said heat exchanger;

(d) distilling said feeds in a distillation column to form a scrubbed overhead vapor rich in methane and a bottoms liquid rich in said hydrocarbon impurities;

(e) cooling said scrubbed overhead vapor against a refrigerant in said heat exchanger to a temperature sufficient to condense and subcool the overhead vapor to form a subcooled methane-rich liquid;

(f) introducing as a reflux to said distillation column a portion of said subcooled methane-rich liquid solely by a liquid/liquid separation of said subcooled methane-rich liquid; and (g) cooling the remainder of said subcooled methane-rich liquid against a refrigerant in said heat exchanger to form a liquefied and purified natural gas.

2. In a process for purifying and liquefying a raw natural gas feed containing methane and hydrocarbon impurities of $C_2$ and higher against a refrigerant in a cryogenic main heat exchanger, which comprises cooling said raw natural gas feed to form a cold feed, distilling said cold feed in a distillation column to form a scrubbed overhead vapor rich in methane and a bottoms liquid rich in said hydrocarbon impurities, cooling said scrubbed overhead vapor against refrigerant in said heat exchanger, refluxing the distillation column with a portion of the cooled scrubbed overhead, and cooling the remainder of the cooled scrubbed overhead against refrigerant in said heat exchanger to form a purified liquefied natural gas, wherein the improvement comprises:

separating said cold feed to form a first feed vapor and a second feed liquid;

cooling said first feed vapor against said refrigerant in said heat exchanger;

after distilling, cooling said scrubbed overhead vapor against refrigerant in said heat exchanger to a temperature sufficient to condense and subcool the overhead vapor and form a subcooled methane-rich liquid; and introducing a portion of said subcooled methane-rich liquid for said refluxing to the distillation column solely by a liquid/liquid separation of said subcooled methane-rich liquid.

3. The process according to claims 1 or 2 wherein the vapor feed of said raw natural gas feed is cooled in the first bundle of a three bundle cryogenic main heat exchanger, said scrubbed overhead vapor is cooled in the second bundle of said main heat exchanger, and said remainder of subcooled liquid is cooled in the third bundle of said main heat exchanger.

4. The process according to claim 3 wherein said first feed vapor cooling further comprises precooling said first feed vapor in heat exchange against the bottoms liquid in the lower end of said distillation column, thereby providing reboiler heat to the column.

5. The process according to claim 4 wherein said cooling in said main exchanger comprises heat exchange against a mixed cryogenic refrigerant.

6. A process according to claim 5 wherein said raw natural gas feed is at a superatmospheric pressure.

7. A process according to claim 6 wherein said reflux comprises methane-rich liquid subcooled in the range of 50° F. to 100° F. below its bubble point.

* * * * *